United States Patent [19]

Griffin

[11] Patent Number: 4,694,636

[45] Date of Patent: Sep. 22, 1987

[54] HORIZONTAL BUNDLING WITH VARIABLE ENTRY AND EXIT CONVEYORS

[75] Inventor: Everett Griffin, High Point, N.C.

[73] Assignee: Burlington Industries, Inc., Greensboro, N.C.

[21] Appl. No.: 246,437

[22] Filed: Mar. 23, 1981

[51] Int. Cl.[4] ..... B65B 13/12

[52] U.S. Cl. ..... 53/399; 53/441; 53/556; 53/588

[58] Field of Search ..... 53/399, 441, 556, 588, 53/148, 210; 198/412, 782, 826; 193/35 C

[56] References Cited

U.S. PATENT DOCUMENTS

| | | | |
|---|---|---|---|
| 736,905 | 8/1903 | Willson | 198/826 |
| 2,630,751 | 3/1953 | Cranston et al. . | |
| 2,667,261 | 1/1954 | Berger . | |
| 2,818,966 | 1/1958 | Gill | 198/826 |
| 3,054,514 | 9/1962 | Riley . | |
| 3,294,218 | 12/1966 | Chanland | 198/826 |
| 3,382,964 | 5/1968 | Bonhoff | 198/782 |
| 3,473,291 | 10/1969 | Raymond et al. . | |
| 3,498,167 | 3/1970 | Hill . | |
| 3,753,505 | 8/1973 | Ousika | 198/412 |
| 4,050,220 | 9/1977 | Lancaster et al. . | |
| 4,104,773 | 8/1978 | Sailas | 29/127 |
| 4,178,734 | 12/1979 | Lancaster et al. . | |
| 4,193,486 | 3/1980 | Boezym | 198/782 |

FOREIGN PATENT DOCUMENTS

| | | | |
|---|---|---|---|
| 45285 | 5/1888 | Fed. Rep. of Germany | 198/826 |
| 926658 | 3/1955 | Fed. Rep. of Germany | 198/826 |
| 968407 | 1/1958 | Fed. Rep. of Germany | 198/826 |
| 2303590 | 8/1973 | Fed. Rep. of Germany | 53/210 |
| 564482 | 6/1957 | Italy | 198/412 |
| 500136 | 3/1976 | U.S.S.R. | 198/782 |
| 779191 | 11/1980 | U.S.S.R. | 198/412 |

*Primary Examiner*—John Sipos

*Attorney, Agent, or Firm*—Cushman, Darby & Cushman

[57] ABSTRACT

An apparatus and method for wrapping one or more elongated articles, such as rolls of fabric, into a multi-sided package which is comprised of an infeed conveyor which conveys articles to be wrapped to a wrapping station and an outfeed conveyor which conveys the resultant multi-sided package away from the wrapping station. The infeed and outfeed conveyors each have a pair of intersecting sets of driven rollers which form a "V" shaped cross-section. The angle subtended by each of the intersecting sets of rollers and the orientation of the plane which bisects the angle may be varied.

16 Claims, 6 Drawing Figures

HORIZONTAL BUNDLING WITH VARIABLE ENTRY AND EXIT CONVEYORS

BACKGROUND AND SUMMARY OF THE INVENTION

The invention relates to a combined wrapping and conveying apparatus and method for wrapping elongated articles with a spiral wrap of material while the articles are being conveyed on a conveyor.

Combined wrapping and conveying systems which wrap articles with a spiral wrap of material while being moved by the conveyor are known per se. For instance, U.S. Pat. No. 4,050,220 discloses a wrapping mechanism which spirally wraps individual packages which are being transported by a conveyor system.

Conveyor systems are also known per se, though not for bundling articles in a package, which have two or more arrays of intersecting driven rollers for conveying articles. See U.S. Pat. Nos. 2,667,261 and 3,473,291. The angle of intersection between the arrays of driven rollers in U.S. Pat. No. 3,473,291 is fixed. The angle of intersection between the arrays of driven rollers in U.S. Pat. No. 2,667,261 may be varied.

The present invention comprises an apparatus and method for wrapping elongated articles, such as rolls of cloth, with a spiral wrap of sheet material, to form a multi-sided package which rests on a predicted flat side when exiting from a conveyor. The invention includes an infeed conveycr which conveys elongated articles which are to be wrapped into a multiple sided package to a wrapping station and an outfeed conveyor for conveying the resultant multi-sided wrapped package which rests on a predicted side from the wrapping station to another location where further processing of the wrapped articles may take place. Both the infeed and outfeed conveyors have a support frame having first and second sets of rotatably driven rollers which intersect to form a "V" shaped cross-section. The V shaped cross-section of the infeed conveyor defines an angle A which has a bisecting plane that intersects the longitudinal axis of the infeed conveyor and the V shaped cross-section of the outfeed conveyor defines an angle B which has a bisecting plane that intersects the longitudinal axis of the outfeed conveyor. The invention includes means for varying the angular orientation of the bisector of the angle A with respect to the bisector of the angle B to permit the multiple sided package which is formed at the wrapping station to be positioned on a predicted side when it leaves the outfeed conveyor and means for varying the angles A and B.

It is the primary object of the present invention to provide an effective and versatile method and apparatus for spiral wrapping of a bundle of conveyed articles. This and other objects of the invention will become clear from an inspection of the detailed description of the invention, and the appended claims.

BRIEF DESCRIPTION OF THE DRAWINGS

FIG. 4(*b*) is an end view of the outfeed conveyor which illustrates the angle B and its bisector.

DETAILED DESCRIPTION OF THE DRAWINGS

Figure 1:
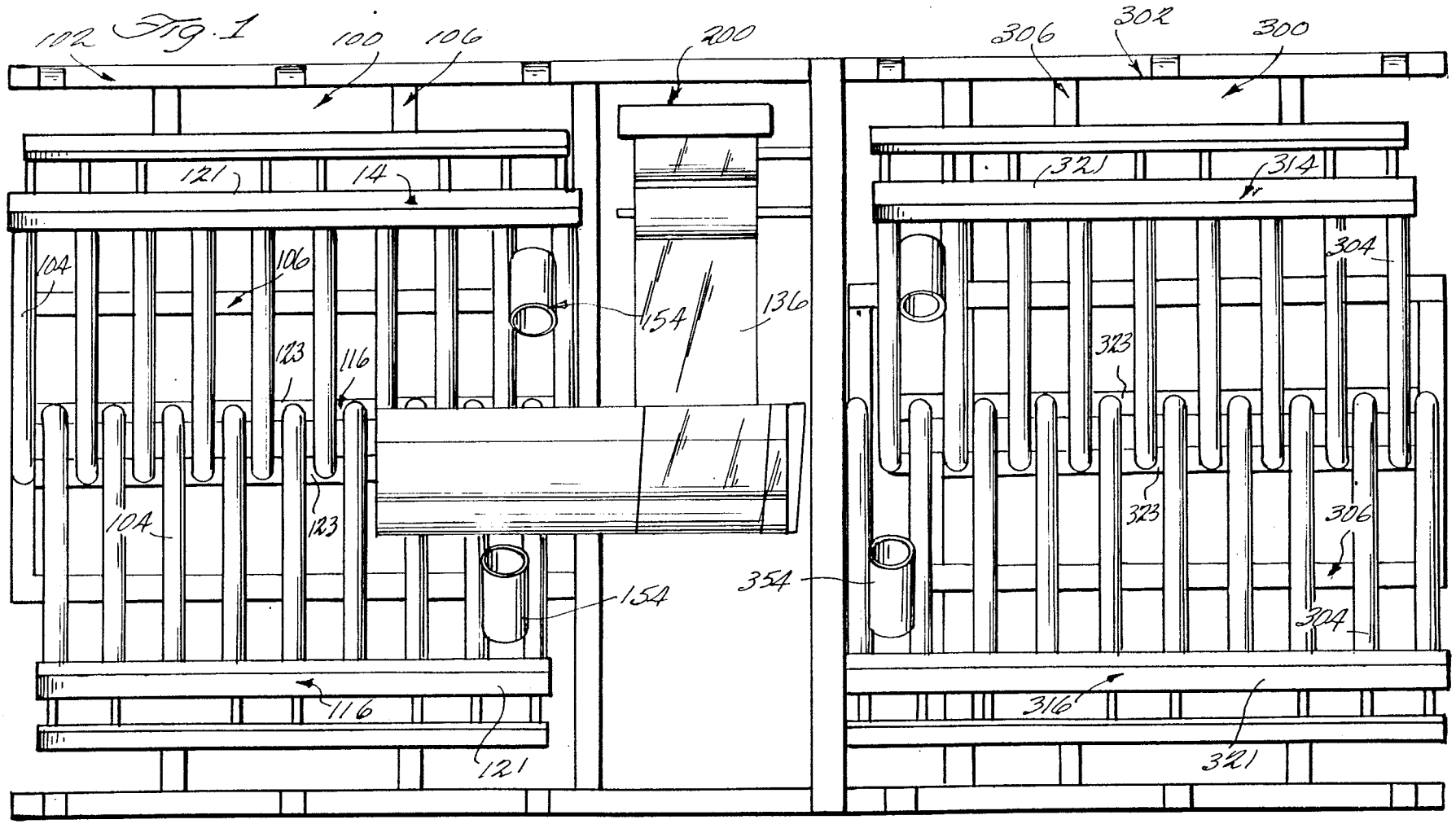
FIG. 1 is a top view of an exemplary apparatus according to the present invention.
Figure 5:
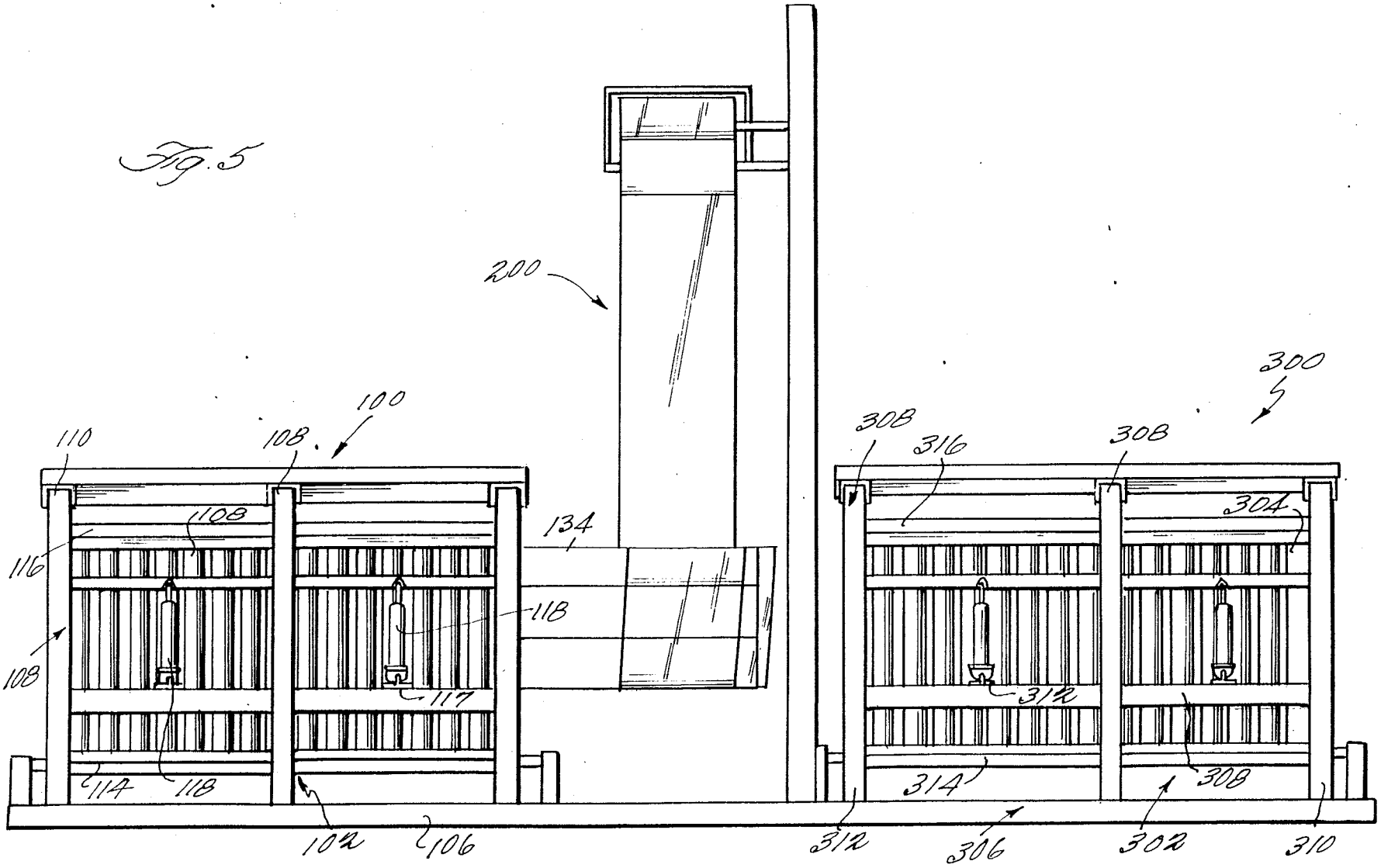
FIG. 5 is a front elevational view of the apparatus of FIG. 1.

A wrapping apparatus in accordance with the present invention has three main parts which are an infeed ccnveyor 100, a wrapping station 200, and an outfeed conveyor 300. FIGS. 1 and 5 respectively illustrate a top view and a front view of the infeed conveyor 100, wrapping station 200 and the outfeed conveyor 300.

The ccnstruction of the infeed conveyor 100 and outfeed conveyor 300 is substantially identical. Identical parts of the infeed and outfeed conveyors are identified in the specification by the antecedents infeed and outfeed, and reference numerals beginning with 100 or 300 respectively.

The infeed and outfeed conveyors respectively have an infeed support frame 102 and an outfeed support frame 302 which support driven rollers 104 and 304 contained in the infeed and outfeed roller frames 114, 116, 314 and 316. Each support frame 102 and 302 includes a base 106 or 306 which rests on a level surface which may be referred to as a reference plane. A plurality of infeed vertical members 108 are welded to the base 106 to form an elevated part of the infeed support frame 102. The pivot points 110 and 112 of the first and second infeed roller frames 114 and 116 and the fixed end 117 of first and second extensible infeed cylinders 118 and 140 are joined to the elevated part of the support frame.

Like the infeed support frame 102, the outfeed support frame 302 includes a plurality of vertical members 308 which are welded to the base 306 to form an elevated part of the outfeed support frame 302 to which are joined the pivot points 310 and 312 of the first and second outfeed roller frames 314 and 316 and the fixed end 317 of first and second extensible outfeed cylinders 318 and 340.

It should be understood that the invention is not limited to a particular form of the infeed and outfeed support frames 114, 116, 314 and 316. Any ccnfiguration of the infeed and outfeed support frames may be used which provides a rigid structure to which the pivot points 110 and 112, 310 and 312, and the fixed ends 117 and 317 may be securely attached. The first and second infeed roller frames 118 and 140 and the first and second outfeed roller frames 318 and 340 respectively rotatably support the plurality of driven rollers 104 and 304. The driven rollers 104 and 304 are journaled in the top and bottom sides 121, 123, 321, 323, of the infeed and outfeed roller frames, 114, 116, 314 and 316.

Figure 2:
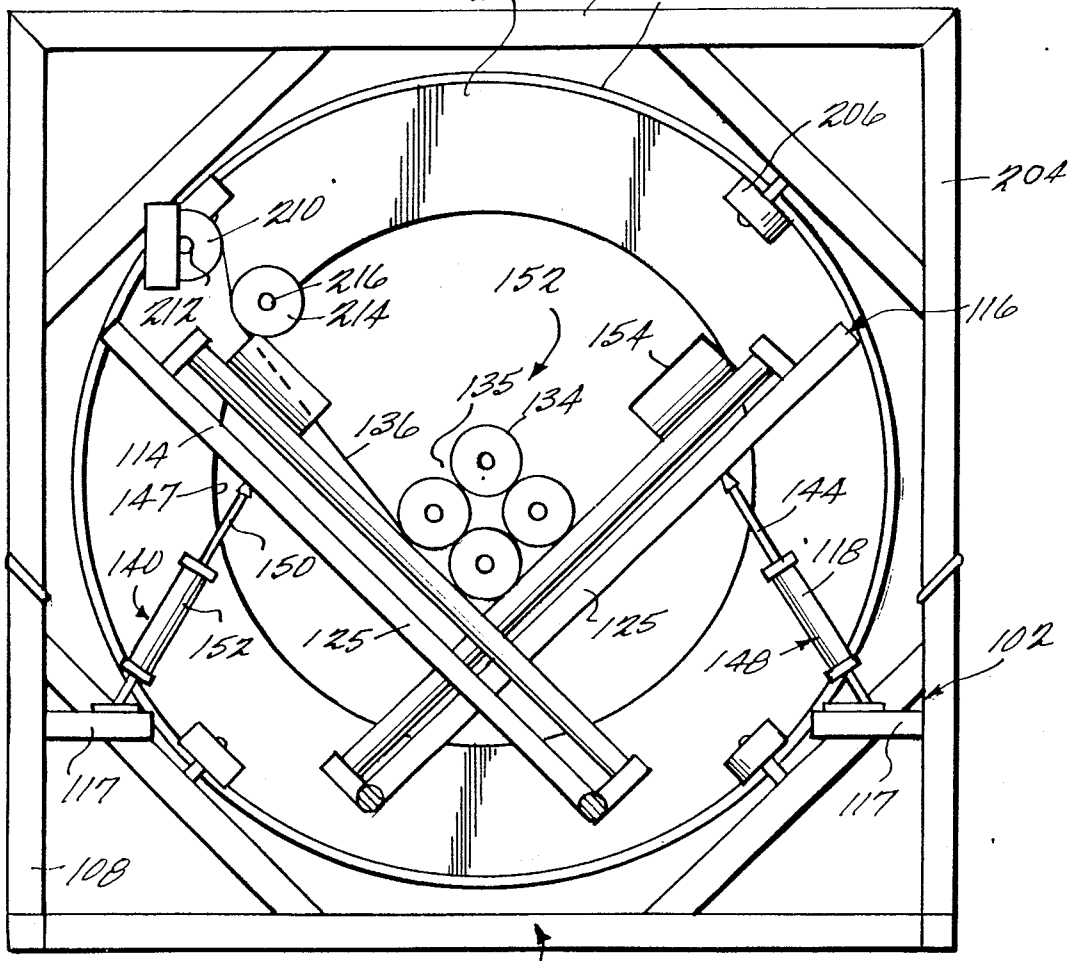
FIG. 2 is an end view of the wrapping station of the apparatus of FIG. 1 as seen from the infeed conveyor.
Figure 3:
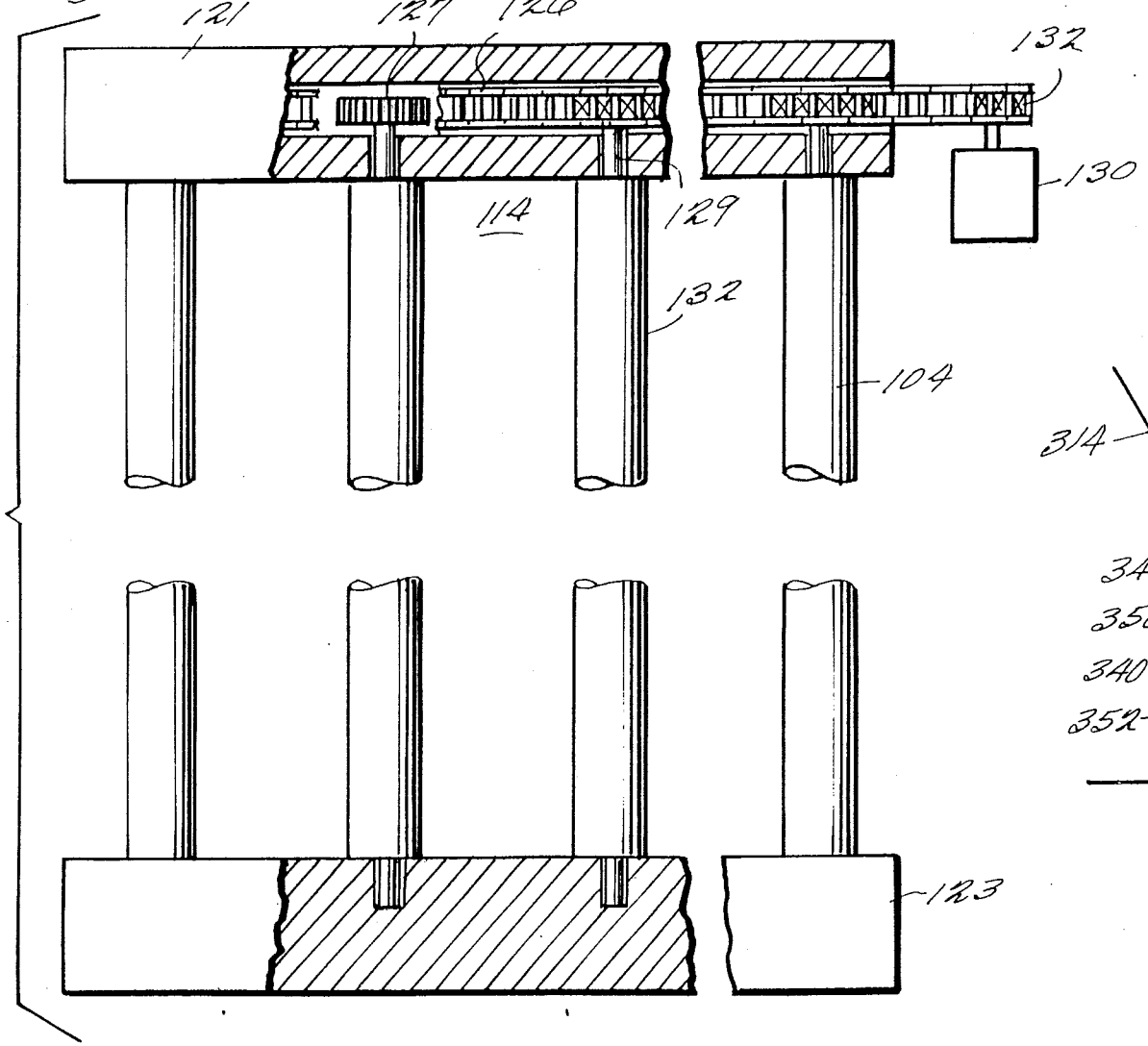
FIG. 3 is a detailed view of the drive mechanism for the rollers of the infeed and outfeed ccnveyors.

The detailed construction of an exemplary drive mechanism for the first infeed roller frame 114 is illustrated in FIG. 3. It should be understood that the construction of the second infeed roller frame 116 and the first and second outfeed roller frames 314 and 316 are identical to the first infeed roller frame 114 and accordingly are not illustrated and discussed in detail. The top and bottom sides 121 and 123 of the first infeed roller frame are braced by a plurality of cross member 125 which are partially illustrated in FIG. 2. It should be understood that the first and second infeed and outfeed roller frames 114, 116, 314 and 316 may use any configuration of top and bottom sides 121, 123, 321 and 323 and cross members which rigidly support the driven rollers 104 and 304 and which provide a frame which may be pivoted from pivot points 110, 112, 310 and 312. The sides 121 and 123 of the infeed roller frame 114 rotatably support the plurality of driven rollers 104 which convey articles upon contact with the driven rollers. Bearings which rotatably support the individual rollers 104 have been omitted from FIG. 3 for purposes of clarity. The side 123 is pivoted in the elevated part of the infeed support frame 114.

Power is applied to the individual driven rollers by a chain 126 and a plurality of sprocket wheels 127 which are located in the top side 121 of the first infeed roller frame 114. A partial section in FIG. 3 illustrates sprocket wheels 127 which are attached to the axis of rotation 129 of each roller 104. The chain 126 engages each sprocket wheel 127 of each axis 129 of rotation of the rollers 104. Application of motion to the chain 126 by a motor 130 and sprocket drive 132 causes each roller 104 to move at precisely the same rotational velocity, to impart a uniform rate of motion to the articles as they move from the infeed conveyor 100 through the wrapping station 200 to the outfeed conveyor 300. The individual rollers 104 and 304 may be wrapped with a wrap of tape 132 or other mterial which has a high coefficient of friction to promote the efficient application of power from the driven rollers 104 to the articles 134 which are being ccnveyed.

Figure 4A:
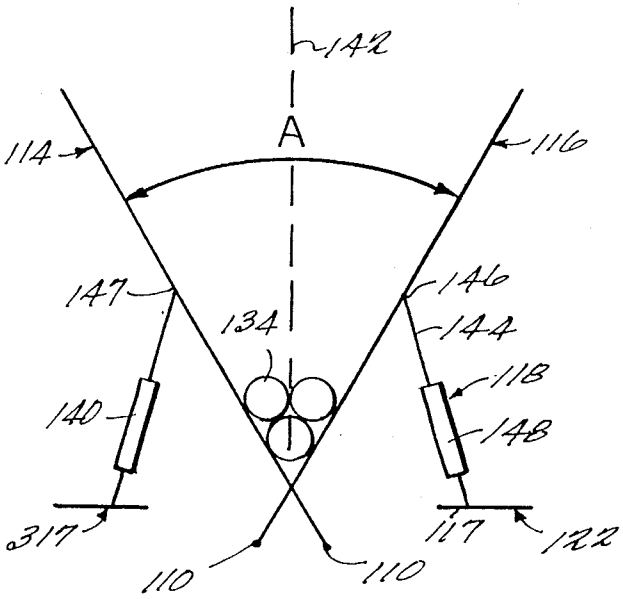
FIG. 4(*a*) is an end view of the infeed conveyor which illustrates the angle A and its bisector.
Figure 4B:
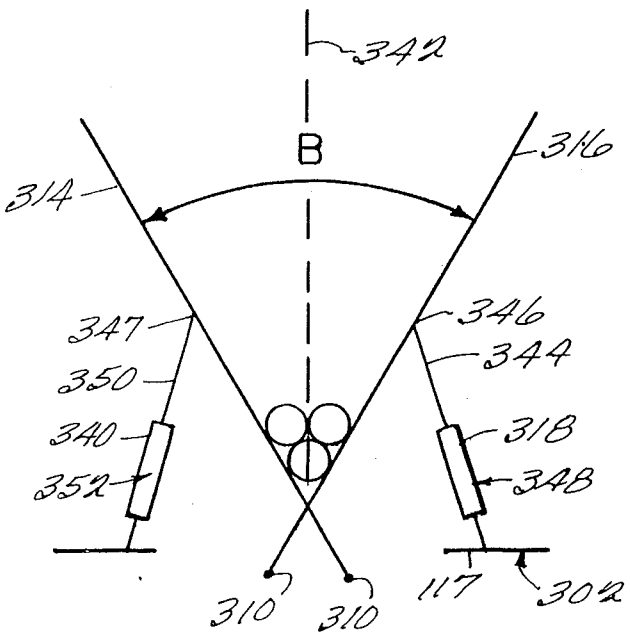

The individual first and second infeed and outfeed roller frames 114, 116, 314 and 316 of the respective infeed and outfeed support frames 102 and 302 form a "V" shaped cross-section which is illustrated from the infeed conveyor side in FIGS. 2 and 4*a* and from the outfeed conveyor side in FIG. 4*b*. The individual articles 134 which are wrapped with wrapping material 136, such as polyethylene, at the wrapping station 200 rest in the V shaped cross-section formed by the pivoting of the first and second roller infeed frames 114 and 116 in the infeed support frame 102. The resultant multi-sided package 136 which is formed by wrapping the plurality of individual articles 134 with wrapping material 136 rests in the V shaped cross-section formed by the first and second outfeed roller frames 314 and 316 in the outfeed support frame 302.

FIGS. 2 and 4*a* illustrate first and second infeed pneumatic cylinders 118 and 140 having extensible rods which are used to adjust the angle A and the angular orientation of the bisector 142 of angle A. The first cylinder 118 has an extensible piston rod 144 which is attached to the first roller infeed frame 116 at a position 146 remote from the pivot points 110 and 112 and a cylinder body 148 which is attached to the infeed support frame 102 at point 117. The second cylinder 140 has an extensible piston rod 150 which is attached to the second roller infeed frame 114 at a position 147 remote from the pivot points 110 and 112 and a cylinder body 152 which is attached to the infeed support frame 102 at point 117.

FIG. 4*b* illustrates first and second outfeed pneumatic cylinders 318 and 340 which are used to adjust the angle B and the angular orientation of the bisector 342 of angle B. The first cylinder 318 has an extensible piston rod 344 which is attached to the first roller outfeed frame 316 at a position 346 remote from the pivot point 310 and a cylinder body 348 which is attached to the outfeed support frame 302 at point 317. The second cylinder 340 has an extensible piston rod 350 which is attached to the second roller outfeed frame 314 at a point 347 remote from the pivot point 310 and a cylinder body 352 which is attached to the outfeed support frame 302 at point 317.

The extension and retraction of the individual piston rods 144, 150, 344 and 350 is controlled by the selective application of compressed air to the pneumatic cylinders in a manner apparent to those persons skilled in the art. It should be understood that the application of air could be accomplished by an automatic control program or manually.

Variation in the angles A and B is useful for accommodating packages of different sizes. Increasing the angles A and B accommodates larger packages and decreasing the angles A and B accommodates smaller packages.

Variation in the angular orientation of the bisector of the angles A and B is useful when a plurality of rolls of fabric are being wrapped and it is desired to orient the package 134 of the wrapped fabric rolls with respect to the "V" shaped cross-section of the outfeed conveyor 300 so that the resultant multi-sided package is on a predicted side when the finished package is discharged from the outfeed conveyor.

Selective retraction or extension of the piston rods 144, 150, 344 and 350 causes the bisectors 142 and 342 to be rotated in either a clockwise or counterclockwise direction. For example, rotation of the bisector 142 in a clockwise direction and the bisector 342 in a counterclockwise direction produces a net rotation between the infeed and outfeed conveyors which equals the sum of the clockwise and counterclockwise rotations. In the preferred embodiment both the infeed and outfeed conveyors 100 and 300 may be rotated clockwise or counterclockwise 30° to produce a possible cumulative variation between the infeed and outfeed conveyors of 60°. The orientation of either of the bisectors may be changed by retraction of one of the associated piston rods by an amount equal to the extension of the other associated piston rod. When there is an equal extension and retraction of piston rods 144 and 150 or 344 and 350, the bisectors of the angles A and B are adjusted without variation in either the angles A or B.

The individual rollers 104 of the first and second infeed roller frames 114 and 116 alternate along the longitudinal axis of the infeed conveyor 100 to form an interleaved pattern. The same interleaved pattern of the rollers 304 is also present in the first and second outfeed roller frames 314 and 316. As an article moves along the longitudinal axis of either the infeed or outfeed conveyors 100 and 300, every other driven roller 104 and 304 which is contacted is within the same roller frame 114, 116, 314 and 316. The alternation of the rollers 104 and 304 along the longitudinal axis of the infeed and outfeed conveyors 100 and 300 produces the smooth uniform application of power to articles as they move along the conveyors.

The wrapping station 200 functions to form a multi-sided package 135 from a wrap of material 136, such as polyethylene, as the articles 134 pass through an annulus 152 within the wrapping station 200. The wrapping station may be conventiona, such as shown in U.S. Pat. Nos. 4,050,220 and 3,788,199, the disclosures of which are hereby incorporated by reference herein. The wrapping includes an annular plate 202 which is rotatably supported from a vertical frame 204 by a plurality of pairs of rollers 206. In FIG. 2, only the individual infeed rollers 206 are illustrated. It should be understood that on the outfeed side there are corresponding rollers 206 having the same angular orientation as the infeed rollers 206. The annular plate 202 has a cylindrical lip 208 which projects toward the infeed and outfeed side of the plate to provide a surface for the rollers 206 to rotatably support the annular plate. The annular plate 202 is rotatably driven by a motor driven capstan which has not been illustrated for reasons of clarity. A roll 210 of sheet material 136 is rotatably attached to the annular plate 202 by a rod 212. An idler roller 214 is provided for tensioning the material 136 as it is wrapped around the articles 134. The idler roller is rotatably attached to the annular plate 202 by a rod 216.

A pair of idler rollers 154 and 354 are mounted on each of the infeed and outfeed frames 102 and 302 at a point remote from the pivot points 110, 112, 310 and 312 of the frames. Each idler roller is oriented with its axis of rotation orthogonal to the axis of rotation of the driven rollers 104 and 304 and perpendicular to the longitudinal axis of the infeed and outfeed conveyors 100 and 300. The idler rollers function to limit the size of packages which may be conveyed.

The operation of the illustrated apparatus is as follows: Initially the angles A and B of infeed and outfeed ccnveyors 100 and 300 and the angular orientation of the bisectors 142 and 342 of the angle A and B are adjusted. Adjustment of the angles A and B is made to accommodate the size of the article 136 to be wrapped. In the case where, for example, a plurality of rolls of fabric are to be wrapped and the resultant article is to be oriented on a predicted side as the article leaves the outfeed conveyor 300, the bisectors 142 and 342 of one or both of the angles A and B are rotated in the manner described above to orient the infeed and outfeed conveyors in a predetermined angular orientation with respect to each other.

After the initial adjustments to the infeed and outfeed conveyors 100 and 300, one or more articles are initially positioned in the vertex of the "V" of the infeed conveyor 100 in proximity to the loose end of the wrapping material 136 which is carried by the rod 212 of the annular plate 202. The initial positioning of the rolls of fabric may be accomplished manually or may alternatively be accomplished by the conveyor system. For instance, as illustrated in FIG. 2, the articles may be a plurality of rolls of fabric 134 which are to be wrapped with a sheet of plastic to form a mult-sided package 135.

After the initial positioning of the rolls of fabric 134, the loose end of the plastic is attached to one of the rolls cf fabric. The infeed and outfeed conveyors 100 and 300 are started and the motor which rotates the annular plate 202 is started. The movement of the fabric rolls 134 through the wrapping station 200 by the infeed and outfeed conveyors 100 and 300 in conjunction with the rotation of the annular plate 202 forms a spiral wrap on the fabric rolls which binds the rolls together as a multi-sided package 135. As the rear end of the package leaves the wrapping station 200 the sheet of wrapping material is cut and both ends of the package 135 are tied to complete the wrapping. The previously chosen angular orientation of the outfeed conveyor 300 insures that the multi-sided wrapped packaged 135 will be resting on a predicted side when it leaves the outfeed conveyor.

At least one of the rollers 104, 304 in the first and second sets of the driven rollers within the infeed and outfeed conveyors 100, 300, is spirally wrapped with a material which produces substantial friction between the surface of the wrapped driven roller and the articles being conveyed by the conveyors. Preferably, at least the rollers 104, 304 closest to the wrapping means 200 are spirally wrapped with such a material.

While the preferred embodiment has been described above, it will be apparent to those persons skilled in the art that numerous modifications may be made to the invention which are within the scope of the appended claims. For example, it should be understood that the detailed construction of the wrapping station may be modified so long as the wrapping station is able to form a spiral wrap of material on articles as they move through the wrapping station so as to form a multi-sided package. Moreover, the mechanism for driving the rollers may be modified so long as the infeed and outfeed conveyors are able to drive the articles to be wrapped smoothly along the infeed conveyor, wrapping station, and outfeed conveyor. The extensible cylinders may be any extensible mechanical device. The invention is not limited to the shape of the individual packages.

What I claim as my invention is:

1. An apparatus for wrapping articles comprising:

(a) an infeed conveyor having an infeed support frame and first and second sets of rotatably driven infeed rollers which intersect to form a conveyor having a "V" shaped cross-section which defines an angle A that is measured between the first and second sets of infeed rollers, the infeed conveyor having a longitudinal axis which is parallel to the direction of motion of aritcles along the infeed conveyor, the angle A having a bisecting plane which intersects the longitudinal axis, the first set of infeed rollers being retained in a first infeed support frame and the second set of infeed rollers being retained in a second infeed roller frame which has a side that is pivoted in the infeed support frame at a pivot point;

(b) an outfeed conveyor having an outfeed support frame and first and second sets of rotatably driven outfeed rollers which intersect to form a conveyor having a "V" shaped cross-section which defines an angle B that is measured between the first and second sets of outfeed rollers, the outfeed conveyor having a longitudinal axis which is parallel to the direction of motion of articles along the outfeed conveyor, the angle B having a bisecting plane which intersects the longitudinal axis of the outfeed conveyor, the first set of infeed rollers being retained in a first outfeed roller frame which has a side that is pivoted in the outfeed support frame and a second outfeed roller frame which has a side that is pivoted in the outfeed support frame at a pivot point;

(c) means disposed between the infeed and outfeed conveyors for wrapping articles with a sheet of material to form a package having a plurality of sides while the articles are conveyed between the infeed and outfeed conveyors; and (d) means for varying the angular orientation of the bisector plane of the angle A with respect to the bisector plane of the angle B so that the package is oriented on a predicted side when it leaves the outfeed conveyor.

2. The wrapping apparatus of claim 1 wherein the means for varying the angular orientation of the bisecting plane of the angle A with respect to the angle B comprises:

(a) means for varying the angular orientation of the bisecting plane of the angle A with respect to a reference plane independent of the orientation of the outfeed conveyor; and (b) means for varying the angular orientation of the bisecting plane of the angle B with respect to the reference plane independent of the orientation of the infeed conveyor.

3. The wrapping apparatus of claim 2 further comprising:

(a) means for varying the angle A between the first and second sets of infeed driven rollers and (b) means for varying the angle B between the first and second sets of outfeed driven rollers.

4. The wrapping apparatus of claim 3 wherein:

(a) the means for varying the angular orientation of the bisecting plane of the angle A and the angle A comprises a first infeed extensible member having a first end which is connected to the first infeed roller frame at a position which is remote from the pivot point of the first infeed roller frame and a second end which is connected to the infeed support frame and a second infeed extensible member having a first end which is connected to the second infeed roller frame at a position which is remote from the pivot point of the second infeed support frame and a second end which is connected to the infeed support frame; and (b) wherein the means for varying the angular orientation of the bisecting plane of the angle B and the angle B comprises a first extensible outfeed member having a first end which is connected to the first outfeed roller frame at a position which is remote from the pivot point of the first outfeed roller frame and a second end which is connected to the outfeed support frame and a second extensible outfeed member having a first end which is connected to the second outfeed roller frame at a position which is remote from the pivot point of the second outfeed roller frame and a second end which is connected to the outfeed support frame.

5. The wrapping apparatus of claim 4 wherein:

(a) the first extensible infeed member is variable in length to define an angle measured between the reference plane and the first infeed roller frame which varies between 30° and 60°;

(b) the second infeed extensible member is variable in length to define an angle measured between the reference plane and the second infeed roller frame which varies between 30° and 60°;

(c) the first outfeed extensible member is variable in length to define an angle measured between the reference plane and the first outfeed roller frame which varies between 30° and 60°; and (d) the second outfeed extensible member is variable in length to define an angle measured between the reference plane and the second outfeed roller frame which varies between 30° and 60°.

6. The wrapping apparatus of claim 5 wherein the extensible members are air powered cylinders.

7. The wrapping apparatus of claim 4 wherein at least one of the rollers in the first and second sets of the driven rollers within the infeed and outfeed conveyors are spirally wrapped with a material which produces substantial friction between the surface of the wrapped driven rollers and the articles being conveyed by the infeed and outfeed conveyors.

8. The wrapping apparatus of claim 7 wherein each article comprises one or more cylindrical rolls which are grouped together and have a longitudinal axis which is parallel to the longitudinal axis of the infeed and outfeed conveyors.

9. The wrapping apparatus of claim 7 wherein:

(a) the individual rollers of the first and second sets of rollers of the infeed conveyor are in an interleaved configuration parallel to the longitudinal axis of the infeed conveyor; and (b) the individual rollers of the first and second sets of rollers of the outfeed conveyor are in an interleaved configuration parallel to the longitudinal axis of the outfeed conveyor.

10. The wrapping apparatus of claim 4 further comprising:

(a) a first infeed idler roller attached to the first infeed roller frame at a position displaced from the pivot point of the first infeed roller frame, the point of attachment of the first idler roller to the first infeed roller frame being fixedly attachable along a line parallel to the axis of rotation of the rollers in the first infeed roller frame, the first idler roller having an axis of rotation which is perpendicular to the axis of rotation of the rollers within the first infeed roller frame and which is perpendicular to the longitudinal axis of the infeed conveyor;

(b) a second infeed idler roller attached to the second infeed roller member at a position displaced from the pivot point of the second infeed roller frame, the point of attachment of the second idler wheel to the second infeed roller frame being fixedly attachable along a line parallel to the axis of rotation of the rollers of the second infeed roller frame, the second idler roller having an axis of rotation which is perpendicular to the axis of rotation of the rollers in the second infeed roller frame and which is perpendicular to the longitudinal axis of the infeed conveyor;

(c) a first outfeed idler roller attached to the first outfeed roller frame at a position displaced from the pivot point of the first outfeed roller frame, the point of attachment of the first outfeed idler wheel to the first outfeed roller frame being fixedly attachable along a line parallel to the axis of rotation of the rollers in the first outfeed roller frame, the first outfeed idler roller having an axis of rotation which is perpendicular to the axis of rotation of the rollers in the first outfeed roller frame and which is perpendicular to the longitudinal axis of the outfeed conveyor; and (d) a second outfeed idler roller attached to the second outfeed roller frame at a position displaced from the pivot point of the second outfeed roller frame, the point of attachment of the second outfeed idler wheel to the second outfeed frame member being fixedly attachable along a line parallel to the axis of rotation of the rollers of the second outfeed frame, the second outfeed idler roller having an axis of rotation which is perpendicular to the axis of rotation of the rollers within the second outfeed roller frame of the infeed conveyor and which is perpendicular to the longitudinal axis of the outfeed conveyor.

11. The wrapping apparatus of claim 1 wherein (a) the axis of rotation of each of the driven rollers of the first and second infeed roller frames is perpendicular to the longitudinal axis of the infeed conveyor; and (b) the axis of rotation of each of the driven rollers of the first and second outfeed roller frames is perpendicular to the longitudinal axis of the outfeed conveyor.

12. A method for wrapping a bundle of elongated articles with a sheet of material to form a package having a plurality of sides, utilizing an infeed conveyor having driven infeed rollers intersecting to form a "V" shaped cross-section which defines an angle A, an outfeed conveyor having a plurality of driven outfeed rollers intersecting to form a "V" shaped cross-section which defines an angle B, and a wrapping device disposed between the infeed and outfeed conveyors, said method comprising the steps of:

(a) disposing a plurality of elongated articles in the "V" of the infeed conveyor;

(b) transporting the bundle of articles from the infeed conveyor to the wrapping device;

(c) wrapping the bundle of articles together into a package with a sheet of wrapping material, to form a package having a plurality of sides, at the wrapping device;

(d) conveying the wrapped package from the wrapping device with the outfeed conveyor, with the package disposed in the "V" of the outfeed conveyor; and (e) varying the angular orientations A and B of both the infeed and outfeed conveyor rollers so that the finished package is reoriented with respect to the conveyor surfaces so that it rests on a predicted side when it leaves the outfeed conveyor.

13. A method as recited in claim 12 wherein the elongated articles are fabric rolls, and wherein the sheet packaging material is plastic sheet.

14. An apparatus for wrapping elongated articles comprising:

an infeed conveyor having an infeed support frame and first and second sets of rotatably driven infeed rollers on said frame and means for mounting said first and second sets of rollers so that they are interspersed, alternating with each other, and intersect to form a conveyor having a "V" shaped cross-section;

an outfeed conveyor substantially identical to said infeed conveyor;

means for wrapping elongated articles with sheet material, said wrapping means disposed between said infeed and outfeed conveyors and in alignment therewith; and means for varying the angular orientation of the first and second sets of rollers for each of said infeed and outfeed conveyors, said varying means comprising, for each set of rollers of each of said infeed and outfeed conveyors, means for pivotally mounting the roller frame adjacent one end thereof and an extensible member having a first end which is connected to the roller frame at a position remote from said pivot point, and a second end which is connected to a stationary portion of said infeed or outfeed support frame, respectively, each extensible member being powered and separately controlled.

15. Apparatus as recited in claim 14 wherein said frame for each set of rollers for each of said infeed and outfeed conveyors comprises a pair of spaced frame members, said rollers supported for rotation about an axis perpendicular to said frame members by said frame members; drive means for driving said rollers, said drive means comprising sprockets formed at one end of each of said rollers within one of said frame members, a chain extending within an elongated passage in said frame member, and a motor exterior of said frame member passage, and operatively engaging said chain to drive said chain to rotate said rollers.

16. Apparatus as recited in claim 14 wherein at least said rollers closest to said wrapping means are spirally wrapped with a material which enhances the frictional engagement between the surface of the wrapped driven rollers and the articles being conveyed.

* * * * *